United States Patent [19]

Satake et al.

[11] Patent Number: 4,853,363

[45] Date of Patent: Aug. 1, 1989

[54] HEAT-SENSITIVE RECORDING MATERIAL

[75] Inventors: Toshimi Satake; Toshiaki Minami; Tomoaki Nagai; Fumio Fujimura, all of Tokyo, Japan

[73] Assignee: Jujo Paper Co., Ltd., Tokyo, Japan

[21] Appl. No.: 178,143

[22] Filed: Apr. 6, 1988

[30] Foreign Application Priority Data

Apr. 9, 1987 [JP] Japan ..... 62-87503

[51] Int. Cl.[4] ..... B41M 5/18

[52] U.S. Cl. ..... 503/210; 427/150; 427/151; 428/913; 428/914; 503/211; 503/212; 503/216; 503/217; 503/221; 503/223; 503/225

[58] Field of Search ..... 427/151, 150, 152; 428/913, 914; 503/216, 217, 221, 225, 210–212, 223

[56] References Cited

FOREIGN PATENT DOCUMENTS 2074687 4/1987 Japan ..... 503/221

*Primary Examiner*—Bruce H. Hess

*Attorney, Agent, or Firm*—Koda and Androlia

[57] ABSTRACT

A heat-sensitive recording material has a substrate and a color-developing layer which comprises a near infrared-absorbing fluorantype leuco dye.

This heat-sensitive recording material provides a superior optical readability in near infrared region.

9 Claims, No Drawings

HEAT-SENSITIVE RECORDING MATERIAL

BACKGROUND OF THE INVENTION

1. Field of the Invention

This invention relates to a heat-sensitive recording material which has a superior optical readability in near infrared region.

2. Prior Art

A heat-sensitive recording sheet that utilizes a heat-color-forming reaction occuring between a colorless or pale-colored chromogenic dyestuff and a phenolic material, or an organic acid is disclosed, for example, in the Japanese Patent Publication Nos. 4160/1968 and 14039/1970 and in the Japanese Laid-Open Patent Publication No. 27736/1973, and is now widely applied for practical use.

In general, a heat-sensitive recording sheet is produced by applying on a support, such as paper, film etc., the coating which is prepared by individually grinding and dispersing a colorless chromogenic dyestuff and a color-developing material into fine particles, mixing the resultant dispersion with each other and then adding thereto binder, filler, sensitizer, slipping agent and other auxiliaries. The costing, when heated, undergoes instantaneously a chemical reaction which forms a color.

These heat-sensitive recording sheets havw now been finding a wide range of applications, including medical or industrial measurement recording instruments, terminal printers of computer and information communication systems, facsimile equipments, printers of electronic calculators, automatic ticket vending machines, and so on.

Further, these heat-sensitive recording sheets omprising the combination of a leuco-dyestuff and a color-developing agent are utilized as thermosensitive labels in POS-system. However, since the color formation is in the visible region, these recording sheets cannot be adapted for reading by a semi-conductor laser in the near infrared region which is used as a bar code scanner.

Besides the heat-sensitive color-developing system in which the above colorless leuco dyestuff is used, a chelate type color-developing system under the use of metal compounds is known.

For examples, the Japanes Patent Publication No. 8787/1957 describes the combined use of iron stearate (electron acceptor) with tannic acid or gallic acid, and the Japanese Patent Publication No. 6485/1959 describes the combined use of an electron acceptor such as silver stearate, iron stearate, gold stearate, copper stearate or mercury behenate with an electron donor such as methyl gallate, ethyl gallate, propyl gallate, butyl gallate or dodecyl gallate.

Although these heat-sensitive recording sheets using a chelate type color-developing system are utilized as thermosensitive label in POS-system, etc, they have a drawback that the readability in using semiconductor of near infrared region as ar-code-scanner is insufficient.

SUMMARY OF THE INVENTION

It is an main object to provide a heat-sensitive material in which an superior optical readability in near infrared region is performed.

the above object is performed by a heat-sensitive reacording material having on a substrate a heat-sensitive color-developing layer containing an electron acceptor and an electron donor which react with each other under chelate formation, wherein the color-developing recording layer comprises a near infrared-absorbing fluorantype leuco dye of the following general formula (I):

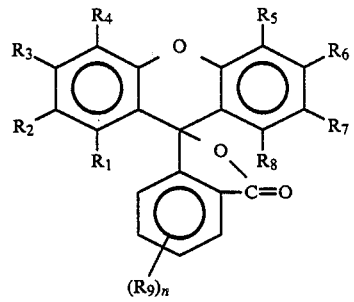

(I)

wherein at least one of $R_1$, $R_2$, $R_3$, $R_4$, $R_5$, $R_6$, $R_7$, $R_8$ and $R_9$ represents

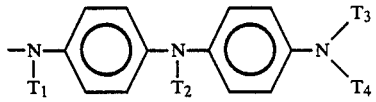

the remainders of $R_1$, $R_2$, $R_3$, $R_4$, $R_5$, $R_6$, $R_7$, $R_8$ and $R_9$, which may be the same or different, represent a hydrogen atom, an alkyl group, an alkoxy group, a cycloalkyl group, a halogen atom, a nitro group, a hydroxy group, an amino group, a substituted amino group, an aralkyl group, a substituted aralkyl group, an aryl group or a substituted aryl group.

$T_1$, $T_2$ and $T_3$, which may be the same or different, represent a hydrogen atom, a $C_3$–$C_9$ alkyl group, a $C_3$–$C_9$ alkenyl group or a $C_3$–$C_9$ alkinyl group;

$T_4$ represents a hydrogen atom, a $C_1$–$C_8$ alkyl group, a $C_3$–$C_9$ alkenyl group, a $C_3$–$C_9$ alkinyl group or a phenyl group; in addition, $T_3$ and $T_4$ taken together with the nitrogen to which they are attached, may represent a morpholino group, a pyrrolidino group, a piperidino group or a hexamethylenimino group; and n represents an integer from 0 to 4.

DETAILED DESCRIPTION OF THE INVENTION

The kind of electron donor is not limitd. However, the preferred electron donor is the metal double salt of higher fatty acid. The metal double salt of higher fatty acid used in this invention means a metal double salt having at least two metal atoms as higher fatty acid-metal in the molecule. Owing to the double salt, the metal double salt of higher fatty acid is clearly different in physical-chemical properties from a higher fatty acid metal salt (metal single salt) containing one metal atom. The metal double salt of higher fatty acid is synthesized by causing the reaction between alkali metal salt or ammonium salt of higher fatty acid and an inorganic metal salt under the use of at least two inorganic metals. Hence, the kind and the mixing ratio of two metal atoms in double salt are unrestrictedly controlled in this synthesis. For example, iron-zinc double salt of behenic acid containing iron and zinc of a mixed ratio 2:1 is obtained by causing a reaction between an aqueous solution of sodium behenate and an aqueous solution of ferric chloride and zinc chloride having a mixed ratio of 2:1.

Suitable metals in the metal double salt of higher fatty acid are other polyvalent metals than alkali metals, for example iron, zinc, calcium, magnesium, aluminum, barium, lead, manganese, tin, nickel, cobalt, copper, silver, quicksilver, etc.; preferable metals are zinc, calcium, aluminum, magnesium and silver. In this invention, there are used metal double salt of higher fatty acid having saturated or unsaturated aliphatic group with 16–35 carbon atoms.

The representative metal double salts of higher fatty acids include the following substances, but they are not limited to these substances.

(1) iron-zinc double salt of stearic acid
(2) iron-zinc double salt of montanic acid
(3) iron-zinc double salt of acid wax
(4) iron-zinc double salt of behenic acid
(5) iron-calcium double salt of behenic acid
(6) iron-aluminum double salt of behenic acid
(7) iron-magnesium double salt of behenic acid
(8) silver-calcium double salt of behenic acid
(9) silver-aluminum double salt of behenic acid
(10) silver-magnesium double salt of behenic acid
(11) calcium-aluminum double salt of behenic acid These metal double salts of higher fatty acids may be used alone as an electron acceptor of heat-sensitive recording sheet. It is possible to use two or more metal double salts of higher fatty acids, simultaneously.

The electron donors of this invention used with the above metal double salt of higher fatty acid are polyvalent hydroxyaromatic compounds, diphenylcarbazide, diphenylcarbazone, hexamethylenetetramine, spirobenzopyran, 1-formyl-4-phenylsemicarbazide, etc.

Particularly, the polyvalent hydroxyaromatic compounds of the following general formula (I) are most preferred.

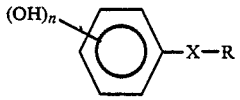

(I)

where R represents alkyl group having 18–35 carbon atoms,

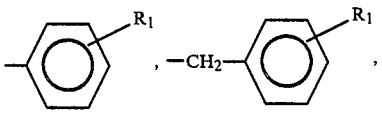

-continued

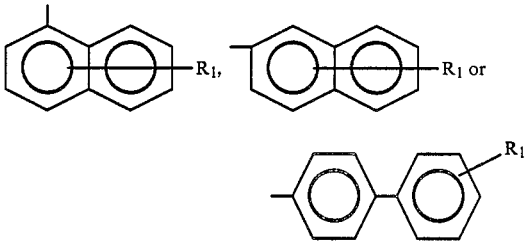

($R_1$ is an alkyl group having 18–35 carbon atoms); n represents an integer from 2 to 3, and —X— represents —$CH_2$—, —$CO_2$—, —CO—, —O—, —CONH— or

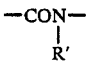

(R' is an alkyl group having 5–30 carbon atoms).

In preparing the coating by dispersing the above polyvalent phenolic derivative in water-system or solvent-system binder, it is required that these phenolic derivatives do not react with the electron-acceptor, and that the solvent-resistance and the dispersing stability of the phenolic derivatives are improved. In this invention, therefore, the substituent group other than the color forming group has a rare carbon number of 18 to 35. Further, it is preferable that the number of hydroxyl groups is 2 to 3 and the hydroxyl groups are adjacent to one another.

These polyvalent phenolic derivatives are used independently. It is possible to use two or more polyvalent phenols, if necessary.

Among the fluorantype leuco dyes of the formula (I), the dyes of the following general formula (II) is preferable.

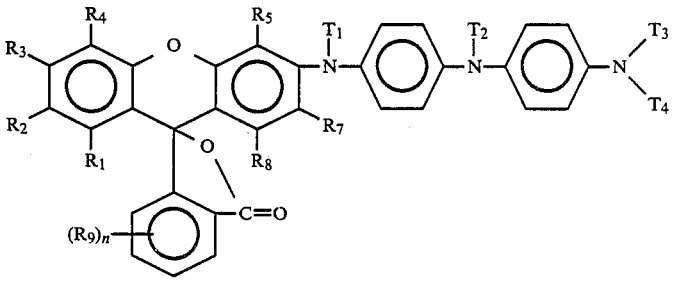

(II)

wherein $R_1$, $R_2$, $R_3$, $R_4$, $R_5$, $R_6$, $R_7$, $R_8$, $R_9$, $T_1$, $T_2$, $T_3$, $T_4$ and n are as defined above.

Taking the productivity, costs and performances into consideration, 2-methyl-6-p-(p-dimethylaminophenyl-)aminoanilinofluoran (m.p: 197°–203° C.) of the following formula (III) and 2-chloro-3-methyl-6-p-(p-phenylaminophenyl)aminoanilinofluoran (m.p: 191.5°–196° C.) of the following formula (IV) are most preferable.

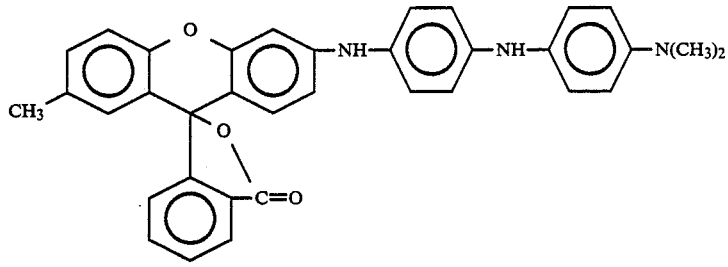

(III)

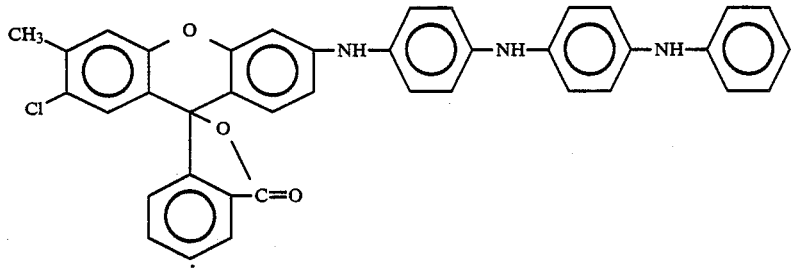

(IV)

The fluoran type leuco dyes of this invention are not particularly limited and include, for example, 2-methyl-6-p-(p-dimethylaminophenyl)aminoanilinofluoran, 2-methoxy-6-p-(p-dimethylaminophenyl)aminoanilinofluoran, 2-chloro-6-p-(p-dimethylaminophenyl)aminoanilinofluoran, p-nitro-6-p-(p-diethylaminophenyl)aminoanilinofluoran, 2-amino-6-p-(p-diethylaminophenyl)aminoanilinofluoran, 2-diethylamino-6-p-(p-diethylaminophenyl)aminoanilinofluoran, 2-phenyl-6-p-(p-phenylaminophenyl)aminoanilinofluoran, 2-benzyl-6-p-(p-penylaminophenyl)aminoanilinofluoran, 2-hydroxy-6-p-(p-phenylaminophenyl)aminoanilinofluoran, 3-methyl-6-p-(p-dimethylaminophenyl)aminoanilinofluoran, 3-diethylamino-6-p-(p-diethylaminophenyl)aminoanilinofluoran, 3-diethylamino-6-p-(p-dibutylaminophenyl)aminoanilinofluoran, 3-methyl-7-p-(p-dimethylaminophenyl)aminoanilinofluoran, 3-methoxy-7-p-(p-dimethylaminophenyl)aminoanilinofluoran, 3-chloro-7-p-(p-dimethylaminophenyl) aminoanilinofluoran, 3-nitro-7-p-(p-diethylaminophenyl) aminoanilinofluoran, 3-amino-7-p-(p-diethylaminophenyl) aminoanilinofluoran, 3-diethylamino-7-p-(p-diethylaminophenyl)aminoanilinofluoran, 3-phenyl-7-p-(p-phenylaminophenyl)aminoanilinofluoran, 3-benzyl-7-p-(p-phenylaminophenyl)aminoanilinofluoran, 3-hydroxy-7-p-(p-phenylaminophenyl)aminoanilinofluoran, 2-methyl-7-p-(p-dimethylaminophenyl)aminoanilinofluoran, 2-diethylamino-7-p-(p-diethylamino)-7-p-(p-diethylaminophenyl)aminoanilinofluoran, 2-diethylamino-7-p-(p-dibutylaminophenyl)aminoanilinofluoran, 2-p-(p-dimethylaminophenyl) aminoanilino-6-methylfluoran, 2-p-(p-dimethylaminophenyl)aminoanilino-6-methoxyfluoran, 2-p-(p-dimethylaminophenyl)aminoanilino-6-chlorofluoran, 2-p-(p-diethylaminophenyl)aminoanilino-6-nitrofluoran, 2-p-(p-diethylaminophenyl)aminoanilino-6-aminofluoran, 2-p-(p-diethylaminophenyl)aminoanilino-6-diethylaminofluoran, 2-p-(p-phenylaminophenyl)aminoanilino-6-phenylfluoran, 2-p-(p-phenylaminophenyl)aminoanilino-6-benzylfluoran, 2-p-(p-phenylaminophenyl)aminoanilino-6-hydroxyfluoran, 2-p-(p-dimethylaminophenyl)aminoanilino-6-methylfluoran, 2-p-(p-diethylaminophenyl)aminoanilino-6-diethylaminofluoran, 2-p-(p-phenylaminophenyl)aminoanilino-6-diethylaminofluoran, 3-p-(p-dimethylaminophenyl)aminoanilino-7-methylfluoran, 3-p-(p-dimethylaminophenyl)aminoanilino-7-methoxyfluoran, 3-p-(p-dimethylaminophenyl)aminoanilino-7-chlorofluoran, 3-p-(p-diethylaminophenyl)aminoanilino-7-nitrofluoran, 3-p-(p-diethylaminophenyl)aminoanilino-7-aminofluoran, 3-p-(p-diethylaminophenyl)aminoanilino-7-diethylaminofluoran, 3-p-(p-phenylaminophenyl)aminoanilino-7-phenylfluoran, 3-p-(p-phenylaminophenyl)aminoanilino-7-benzylfluoran, 3-p-(p-phenylaminophenyl)aminoanilino-7-hydroxyfluoran, 3-p-(p-dimethylaminophenyl)aminoanilino-7-methylfluoran, 3-p-(p-diethylaminophenyl)aminoanilino-7-diethylaminofluoran, and 3-p-(p-phenylaminophenyl)aminoanilino-7-diethylaminofluoran.

As the binders of this invention, there can be mentioned, for example, a fully saponified polyvinyl alcohol having a polymerization degree of 200–1900, a partially saponified polyvinyl alcohol, carboxylated polyvinyl alcohol, amide-modified polyvinyl alcohol, sulfonic acid-modified polyvinyl alcohol, butyral-modified polyvinyl alcohol, other modified polyvinyl alcohol, hydroxyethyl cellulose, methyl cellulose, carboxymethyl cellulose, styrene/malic acid anhydride copolymers, styrene/butadiene copolymers, cellulose delivatives such as ethyl cellulose, acetyl cellulose, etc.; polyvinyl chloride, polyvinyl acetate, polyacryl amide, polyacrylic acid ester, polyvinyl butyrol, polystyrol and copolymers thereof; polyamide resin, silicone resin, petroleum resin, terpene resin, ketone resin and cumaron resin.

These polymeric materials may be used after they were dissolved in a solvent such as water, alcohol, ketone, ester hydrocarbon, etc., or after they were emusified or dispersed in water or a solvent other than water.

The species and the amount of electron acceptor such as metal double salt of higher fatty acid, electron doner such as phenolic derivatives, near infrared-absorbing leuco dye, binder and other ingredients, which are used in this invention, are determined depending upon the performance and recording aptitude required for the recording material, and are not otherwise limited. However, in ordinary cases, it is suitable to use 1–6 parts by weight of electron doner, 0.5–5 parts by weight of near infrared-absorbing leuco dye, 0.5–4 parts by weight of binder and 5–20 parts by weight of filler, based on 1–9 parts by weight of electron acceptor.

The aimed heat- and light-sensitive recording material may be obtained by coating the above coating composition on a substrate such as paper, synthetic paper, film, etc.

The above electron acceptor, the above electron donor and the above basic colorless dye are ground to a particle size of several microns or smaller by means of a grinder or emulsifier such as a ball mill, attritor, sand grinder, etc., and binders and various additives in accordance with the purpose, are added thereto to prepare coating color. Such additives are as follows: filler; releasing agent for prevention of sticking, such as fatty acid metal salt; anti-fogging agent such as fatty acid amide, ethylenebisamide, montan wax, polyethylene wax etc.; dispersant such as sodium dioctylsulfosuccinate, sodium dodecylbenzene sulfonate, sodium lauryl alcohol sulfate, sodium alginate; UV-absorber such as benzophenone type or triazole type; antifoamer; fluorecent brightening agent; water resistance agent; and so on.

As filler, there may be used any organic or inorganic filler usually used in the paper-manufacturing field. Examples for fillers of this invention include clay, talc, silica, magnesium carbonate, alumina, aluminum hydroxide, magnesium hydroxide, barium sulfate, kaolin, titatnium dioxide, zinc oxide, calcium carbonate, aluminum oxide, urea-formalin resin, polystyrene resin, phenol resin, etc.

FUNCTION

The reason why the heat-sensitive recording sheet of this invention provides a superior optical readability in the near infrared region is thought as follows. In a color-developing under formation of a complex compound obtained by heat-melting reaction between a metal double salt of higher fatty acid as electron acceptor and an electron donor such as polyvalent phenolic derivatives, a colored image in visible and near infrared region is formed. However, the combination of an electron acceptor and an electron donor provides a lower absorption of near infrared rays, which can not be used practically. Hence, there is added a near infrared-absorbing-fluorantype leuco dye of the formula (I) which can absorb the light of near infrared region efficiently in a heat-melt reaction with an electron donator such as polyvalent phenolic derivatives. In this manner, there is obtained a heat-sensitive recording material which provides a superior optical readability in near infrared region.

EXAMPLES

This invention will be described by way of example hereunder. Throughout the specification the parts are units by weight.

Example 1 (Test Nos. 1–4)

| Liquid A (dispersion of electron acceptor) | |
|---|---|
| metal double salt of higher fatty acid (see Table 1) | 9.0 parts |
| 10% aqueous solution of polyvinyl alcohol | 10.0 parts |
| water | 6.0 parts |
| **Liquid B (dispersion of electron donor)** | |
| polyvalent phenolic derivative (see Table 1) | 6.0 parts |
| zinc stearate | 1.5 parts |
| 10% aqueous solution of polyvinyl alcohol | 13.75 parts |
| water | 8.25 parts |
| **Liquid C (dispersion of near infrared-absorbing dye)** | |
| near infrared-absorbing dye (see Table 1) | 0.5 parts |
| 10% aqueous solution of polyvinyl alcohol | 1.25 parts |
| water | 0.75 parts |

The liquids A, B and C of the above-mentioned composition were individually ground to a particle size of 3 microns by attritor. Then, the dispersions were mixed in the following portion to prepare the coating color.

| | |
|---|---|
| Liquid A | 25.0 parts |
| Liquid B | 29.5 parts |
| Liquid C | 2.5 parts |
| Kaolin clay (50% aqueous dispersion) | 12.0 parts |

The coating color was applied on one side of a base paper weighing 50 g/m$^2$ at a coating weight of 6.0 g/m$^2$ and was then dried. The resultant paper was treated to a smoothness of 200–600 seconds by a supercalender. In this manner, a heat-sensitive recording sheet was obtained.

Comparative Example (Test Nos. 13–16)

| Liquid D (dispersion of electron acceptor) | |
|---|---|
| metal double salt of higher fatty acid (see Table 1) | 9.0 parts |
| 10% aqueous solution of polyvinyl alcohol | 10.0 parts |
| water | 6.0 parts |
| **Liquid F (dispersion of electron donor)** | |
| polyvalent phenolic derivative (see Table 1) | 6.0 parts |
| zinc stearate | 1.5 parts |
| 10% aqueous solution of polyvinyl alcohol | 13.75 parts |
| water | 8.25 parts |

The liquids D and F of the above-mentioned composition were individually ground to a particle size of 3 microns by attritor. Then, the dispersions were mixed in the same portion as in Example to prepare the coating color

| | |
|---|---|
| Liquid D | 25.0 parts |
| Liquid F | 29.5 parts |
| Kaolin clay (50% aqueous dispersion) | 12.0 parts |

Using the above coating color, a heatsensitive recording sheet was obtained in the same manner as in Example 1.

The heat-sensitive recording sheets obtained in Example and Comparative Example were tested for the following articles. The test results were shown in Table 1.

TABLE 1

Test Results

| | Test No. | Electron acceptor | Electron donor | Near infrared-absorbing leuco dye | Dynamic image density (1) | Infrared reflectance (2) (%) |
|---|---|---|---|---|---|---|
| Example | 1 | Fe.Zn double salt of behenic acid (2:1) | 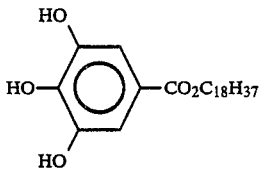 | 2-chloro-3-methyl-6-p-(p-phenylaminophenyl) aminoanilinofluoran | 1.01 | 50 |
| | 2 | Fe.Zn double salt of behenic acid (2:1) | 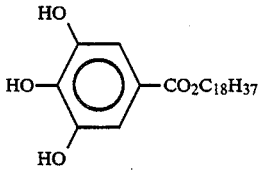 | 2-methyl-6-p-(p-dimethylaminophenyl) aminoanilinofluoran | 0.99 | 51 |
| | 3 | Fe.Al double salt of stearic acid (2:1) | 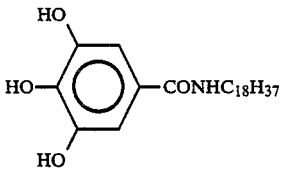 | 2-chloro-3-methyl-6-p-(p-phenylaminophenyl) aminoanilinofluoran | 1.00 | 53 |
| | 4 | Ag.Mg double salt of stearic acid (2:1) | 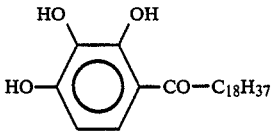 | 2-methyl-6-p-(p-dimethylaminophenyl) aminoanilinofluoran | 0.98 | 52 |
| Comparative Example | 5 | Fe salt of behenic acid | 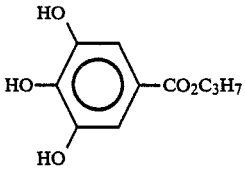 | — | 1.01 | 67 |
| | 6 | Ag salt of behenic acid | 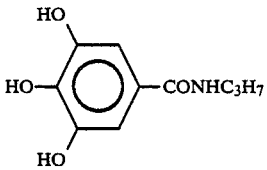 | — | 0.96 | 67 |
| | 7 | Fe salt of stearic acid | 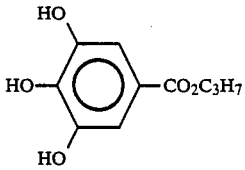 | — | 0.47 | 69 |
| | 8 | Ag salt of stearic acid | 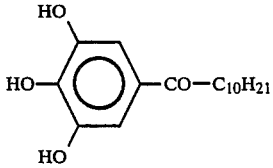 | — | 0.64 | 68 |

*(2:1) means a mole ratio of metals in a metal double salt of higher fatty acid.

NOTE (1) Image density: A heat-sensitive recording sheet was recorded in a pulse width of 3.2 milliseconds and an impressed voltage of 18.03 volts by using the thermal facsimile KB-4800 manufactured by TOSHIBA CORPORATION and the optical density of the recorded image was measured by a Macbeth densitometer. (using RD-514 and amber filter, the same in the following)

(2) Infrared reflectance (%): The infrared reflectance of the image portion recorded by the method of Note (1) was measured by a spectrophotometer (waelength: 800 nm)

Effects of this invention

The effects of this invention are as follows:

(1) Superior optical readability in near infrared region.

We claim:

1. A heat-sensitive recording material comprising a substrate having theron a color-developing layer which contains an electron acceptor and an electron donor which react with each other under chelate formation, said color-developing recording layer comprising a near infrared-absorbing fluorantype leuco dye of the following general formula (I):

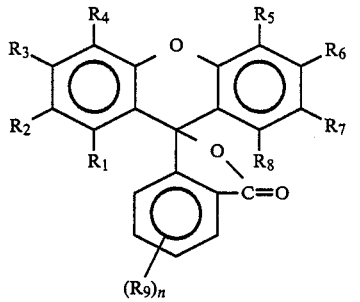

(I)

where at least one of $R_1$, $R_2$, $R_3$, $R_4$, $R_5$, $R_6$, $R_7$, $R_8$ and $R_9$ represents

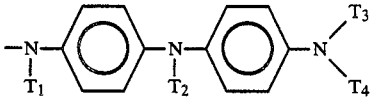

the remainders of $R_1$, $R_2$, $R_3$, $R_4$, $R_5$, $R_6$, $R_7$, $R_8$ and $R_9$, which may be the same or different, represent a hydrogen atom, an alkyl group, an alkoxy group, a cycloalkyl group, a halogen atom, a nitro group, a hydroxy group, an amino group, a substituted amino group, an aralkyl group, a substituted aralkyl group, an aryl group or a substituted aryl group;

$T_1$, $T_2$ and $T_3$, which may be the same or different, represent a hydrogen atom, a $C_3$–$C_9$ alkyl group, a $C_3$–$C_9$ alkenyl group or a $C_3$–$C_9$ alkinyl group;

$T_4$ represents a hydrogen atom, a $C_1$–$C_8$ alkyl group, a $C_3$–$C_9$ alkenyl group, a $C_3$–$C_9$ alkinyl group or a phenyl group; in addition, $T_3$ and $T_4$ taken together with the nitrogen to which they are attached, may represent a morpholino group, a pyrrolidino group, a piperidino group or a hexamethylenimino group; and n represents an integer from 0 to 4.

2. The heat-sensitive recording material according to claim 1, wherein said acceptor comprises a metal double salt of higher fatty acid having 16–35 carbon atoms.

3. The heat-sensitive recording material according to claim 2, wherein said metal double salt of higher fatty acid comprises at least two metals selected from a group consisting of iron, zinc, calcium, magnesium, aluminum, barium, lead, manganese, tin, nickel, cobalt, copper, silver and quicksilver.

4. The heat-sensitive recording material according to claim 1, wherein said electron donor is at least one member selected from a group consisting of polyvalent hydroxyaromatic compound, diphenylcarbazide, diphenylcarbazone, hexamethylenetetramine, spirobenzopyran, and 1-formyl-4-phenylsemicarbazide.

5. The heat-sensitive recording material according to claim 4, wherein said donor is a polyvalent hydroxyaromatic compound represented by the following general formula (I):

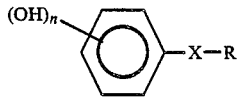

(I)

wherein R represents alkyl group having 18–35 carbon atoms,

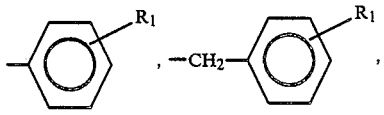

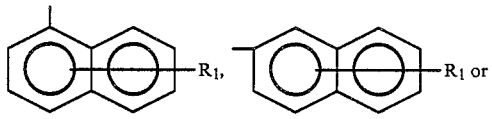

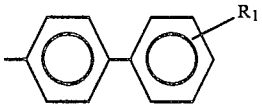

($R_1$ is an alkyl group having 18–35 carbon atoms); n represents an integer from 2 to 3, and -x- represents —$CH_2$—, —$CO_2$, —CO—, —O—, —CONH—0 or

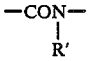

(R′ is an alkyl group having 5–30 carbon atoms).

6. The heat-sensitive recording material according to claim 1, wherein said fluorantype leuco dye of the general formula (I) is at least one dye selected from a group of 2-chloro-3-methyl-6-p-(p-phenylaminophenyl-)aminoanilinofluoran and 2-methyl-6-p-(p-dimethylaminophenyl)aminoanilinofluoran.

7. The heat-sensitive recording material according to claim 1, wherein said color-developing layer comprises 1–6 parts by weight of electron donor, 0.5–6 parts by weight of near infrared-absorbing fluorantype leuco dye, 0.5–4 parts by weight of binder and 5–20 parts by weight of filler, based on 114 9 parts by weight of electron acceptor.

8. The heat-sensitive recording material according to claim 1, wherein said substrate is film.

9. The heat-sensitive recording material according to claim 8, wherein said film is comprised of paper.

* * * * *